US005916826A

United States Patent [19]

White

[11] Patent Number: 5,916,826

[45] Date of Patent: Jun. 29, 1999

[54] PELLETIZING AND BRIQUETTING OF COAL FINES USING BINDERS PRODUCED BY LIQUEFACTION OF BIOMASS

[75] Inventor: Donald H. White, Tucson, Ariz.

[73] Assignee: Waste Technology Transfer, Inc., Tucson, Ariz.

[21] Appl. No.: 08/985,399

[22] Filed: Dec. 5, 1997

[51] Int. Cl.[6] ..... C10L 5/00; C10L 5/02

[52] U.S. Cl. ..... 44/551; 44/552; 44/553; 44/564; 44/569; 44/579; 44/593

[58] Field of Search ..... 44/593, 552, 564, 44/553, 567, 569, 551, 578, 596

[56] References Cited

U.S. PATENT DOCUMENTS

| | | | |
|---|---|---|---|
| 421,878 | 2/1890 | Wiesner | 44/578 |
| 829,042 | 8/1906 | Wagner | 44/578 |
| 851,381 | 4/1907 | Robeson | 44/578 |
| 1,503,304 | 7/1924 | Damon | 44/551 |
| 1,724,393 | 8/1929 | Walkington et al. | 44/551 |
| 1,871,104 | 8/1932 | Willard | 44/596 |
| 1,890,491 | 12/1932 | Bergins et al. | 44/578 |
| 3,073,751 | 1/1963 | Gorin et al. | 44/551 |
| 3,829,297 | 8/1974 | Crawford | 44/551 |
| 3,966,427 | 6/1976 | Herment et al. . | |
| 4,045,537 | 8/1977 | Hrishikesan | 423/119 |
| 4,152,119 | 5/1979 | Schulz | 44/578 |
| 4,169,711 | 10/1979 | Anderson . | |
| 4,219,519 | 8/1980 | Gokel | 264/82 |
| 4,326,854 | 4/1982 | Tanner | 44/578 |
| 4,389,218 | 6/1983 | Pike | 44/544 |
| 4,405,331 | 9/1983 | Blaustein et al. . | |
| 4,497,661 | 2/1985 | Valenti | 75/256 |
| 4,529,407 | 7/1985 | Johnston et al. | 44/596 |
| 4,586,936 | 5/1986 | Schaffer et al. | 44/10 |
| 4,618,347 | 10/1986 | Watt et al. | 44/16 |
| 4,738,685 | 4/1988 | Goleczka et al. | 44/15 B |
| 4,863,485 | 9/1989 | Schaffer et al. | 44/16 |
| 5,009,671 | 4/1991 | Franke et al. | 44/15 B |
| 5,089,540 | 2/1992 | Armbruster et al. | 523/213 |
| 5,244,473 | 9/1993 | Sardessal et al. | 44/553 |
| 5,250,080 | 10/1993 | Michelena et al. | 44/475 |
| 5,562,743 | 10/1996 | Daugherty et al. | 44/589 |

*Primary Examiner*—Margaret Medley
*Attorney, Agent, or Firm*—Antonio R. Durando

[57] ABSTRACT

A coal agglomerate is produced by the combination of coal fines with a binder obtained by the direct liquefaction of biomass material. The direct liquefaction is carried out in the absence of oxygen at typical temperatures between about 450 and 700° F. and typical pressures between 200 and 3,000 psi, according to known liquefaction processes. The liquefied bio-binder base is mixed with additives, if desired, such as fast pyrolysis tars and petroleum asphalt, in order to modify its characteristics to meet specific needs of particular applications, and the resulting mixture is sprayed on coal fines preheated to at least 250° F. and allowed to react at about 300–400° F. Combustible extenders and fillers; reinforcing fibers; and cross-linking agents may be mixed with the coal prior to combination with the binder to provide additional specific properties to the mixture. The resulting well mixed mass is then pelletized by the application of pressure in conventional equipment.

17 Claims, 8 Drawing Sheets

PELLETIZING AND BRIQUETTING OF COAL FINES USING BINDERS PRODUCED BY LIQUEFACTION OF BIOMASS

BACKGROUND OF THE INVENTION

1. Field of the Invention

This invention is related in general to the field of pelletizing and briquetting of coal fines and, in particular, to a novel approach based on the use of liquefied biomass as a reactive coal binder.

2. Description of the Related Art

In coal mining processing and handling, enormous tonnages of coal fines are created Typically, after handling and cleaning is completed, about fifteen to twenty percent of the tonnage mined consists of fines ranging in size from powder to small granules For the most part, these fines are not directly usable, thereby leaving great quantities of material that is wasted and represents a hazardous and expensive disposal problem. While a portion of the coal fines can be combined with coarser fractions of mine production for sale, the inclusion of all fines often reduces the quality of the product below market requirements Accordingly, coal-fines handling, storage and disposal operations represent a significant and unproductive expense for the industry.

A problem that contributes to the underutilization of coal fines for conventional uses is their relatively high moisture content after processing in coal preparation plants. Obviously, the price of coal depends on its heating value and is increased by reducing the moisture content. Therefore, the coal industry typically reduces the moisture in coal prior to shipment to utilities and industrial customers in order to increase its heating value and price. In addition, reducing the moisture content of coal increases the efficiency of power plants and decreases transportation costs. The process of reducing coal moisture, though, further contributes to the problem of coal fines production because conventional coal drying processes generate large amounts of coal fines, which are created as water is removed by the weakening of the coal structure and the attrition of coal particles. Thus, coal drying operations represent another source of fines that are either wasted or represent an added operating expense.

Lower-rank coals, which include lignite and some bituminous coals, are generally regarded as a low quality fuel source because of their high water and fines contents in addition to their lower Btu values. On average, pure forms of lower-rank coals contain up to about 60% moisture by weight, which causes a substantial percentage of the energy produced by these coals being used to dry them prior to full combustion. During production, because of their softness, lower-rank coals break down and produce a higher than normal volume of fines. This makes their handling extremely difficult and also hazardous because the large surface area associated with large volumes of fines results in an increased tendency for spontaneous combustion.

Despite these disadvantages, though, lower-rank coals may also provide significant advantages to industry, often in the form of low ash and low nitrogen contents, high reactivity and lower mining costs. However, in order to exploit these advantages industrially, both the problems of moisture content and fines handling must be addressed.

As a result of these problems, as well as of strict customer demands with respect of coal quality and of increasingly stringent regulation of mine waste disposal practices to satisfy environmental standards, coal fines utilization has been recently reexamined by the industry. In the past, fines have been used mostly for manufacturing briquettes for home and commercial heating. Coal briquetting technology focused on low pressure agglomeration of coal fines, using a binder, typically of coal tar origin, to hold individual particles together. This technology flourished during the early part of the century, when coal-briquette products were utilized as a home heating fuel, but this application has essentially disappeared since the end of World War II because of a shift to other, more convenient sources of fuel. Therefore, this opportunity for commercial utilization of coal fines has been drastically reduced.

The fines material from mining operations is frequently in the form of a wet filter cake containing between about twenty and thirty percent moisture, depending upon its size distribution and ash content. In a dry state, the fines are generally predominantly passable through a 28-mesh screen, a size that may be used for pelletizing and/or briquetting purposes. As used in this disclosure, the terms pellet, briquette, log and block are used interchangeably and are intended to refer to all forms of pellets, briquettes, logs, blocks and other coal agglomerates produced by binding coal fines into a concrete material. Similarly, the terms pelletizing and briquetting are intended to refer to equivalent processes for producing coal agglomerates and are also used interchangeably.

Numerous processes have been proposed and implemented in the past for pelletizing and/or briquetting particles of coal or coke. For example, U.S. Pat. No. 44,994, issued over a century ago, teaches that coal dust can be pelletized by saturating it with a solution of starch, pressing or otherwise forming it into blocks or lumps, and drying it in the sun or by other suitable means. U.S. Pat. No. 852,025 discloses preparing coal for briquetting by drying and heating it, mixing in an asphaltic binder material, then heating, cooling, and compacting the mixture. U.S. Pat. No. 1,121,325 discloses briquetting coal fines by mixing dry coal and starch, adding steam that is saturated with oil, then compressing and thermally drying the mixture. U.S. Pat. No. 1,851,689 discloses briquetting coal fines by mixing the coal with a starch/oil emulsion and then autoclaving it at 300° F. U.S. Pat. No. 4,049,392 discloses an extrusion apparatus, as described in U.S. Pat. No. 3,989,433, for extruding rod-like bodies from coal-containing particulate mixtures, and having means for adjusting the length and density of the extruded particles.

The current emphasis in finding useful applications for coal fines is their utilization in combination with binders to produce pellets especially for the stoker coal markets, but also as a more convenient method of shipping to electric power plants for subsequent on-site pulverization and combustion. Thus, the stoker markets include a large industrial component that could provide an outlet for the economic and efficient consumption of this material that is currently largely wasted.

Many natural and synthetic polymers have been utilized as binders for coal fines. U.S. Pat. No. 5,244,473 teaches that a binder for coal fines can be made from a phenol-aldehyde resin mixed with a polyisocyanate in the presence of a catalyst. U.S. Pat. No. 5,089,540 teaches that a binder for foundry molds can be an ester-cured alkaline phenolic resin, which can be enhanced by conditioning the reclaimed sand with a solution containing an amine and a silane. U.S. Pat. No. 5,009,671 teaches that coal briquettes can be made by using a starch binder mixed with molasses and water. U.S. Pat. No. 4,862,485 teaches how to make coal pellets by mixing coal particles with polyvinyl alcohol, calcium oxide and/or magnesium oxide and water. U.S. Pat. No. 4,738,685 teaches how to cold press coal fines with molasses, an inorganic hardening agent such as calcium carbonate, calcium phosphate, iron oxide, aluminum oxide and optionally with an acid. U.S. Pat. No. 4,618,347 teaches how to make coal pellets from coal dust and a binder consisting of lignosulfonate plus sodium dichromate, while using sulfuric acid as a curing agent. U.S. Pat. No. 4,586,936 shows how to make coal pellets from lower rank coal mixed with cationic polyurethane and polyvinyl alcohol. U.S. Pat. No. 4,169,711 discloses that coal particles (¼ to ¾ inch) mixed with coal fines can be briquetted into 'smokeless' fuel logs when mixed with sodium silicate and/or potassium silicate. Finally, U.S. Pat. No. 3,966,427 teaches how to make coal briquettes using bitumen or bitumen emulsions as binders.

Many prior-art binders use water in the process of mixing with coal fines to produce briquettes, thereby further increasing the moisture content of the product. Thus, for example, when starch-based binders are used, the resulting green pellets must be dried to achieve acceptable fuel performance and reduce transportation costs. In addition, prior-art binders are derived from useful and often expensive raw materials, such as natural and synthetic polymers; therefore, they add significantly to the overall cost of the briquette. Finally, known binders perform an adhesive function by physically binding the coal particles together to form a larger mass; no chemical reaction which would strengthen the bond is understood to take place between the binder and the coal particles.

Therefore, there is still a need for improved binders and briquetting processes. The present invention is based on the discovery that biomass waste materials can be effectively utilized to produce a coal-fines binder that represents a significant improvement over the properties of the binders used to date.

BRIEF SUMMARY OF THE INVENTION

One primary goal of this invention is the development of a more effective binder for briquetting coal fines than available today; in particular, the invention is partly based on the objective of producing a coal binder that reacts chemically with the coal particles constituting the briquette, thereby producing a more stable and cohesive briquette.

Another goal is a coal binder that is produced from waste material, thereby reducing the overall cost of the raw materials constituting the briquette Still another goal of the invention is a binder and a binding process that do not increase the water content in the resulting briquette and do not require drying of the product.

Another objective is a binder that improves retention of volatiles in the coal, thereby reducing loss of combustible material and increasing the efficiency of the briquetting process.

Finally, an objective of the invention is a binder that can be produced inexpensively from raw material that is readily available in commerce as waste, and that is suitable for producing briquettes at costs comparable with prior-art processes.

Therefore, according to these and other objectives, the present invention consists of the combination of coal fines with a binder produced by the direct liquefaction of biomass material in the absence of oxygen at typical temperatures between about 450 and 700° F. and typical pressures between 200 and 3,000 psi according to known liquefaction processes. The liquefied biomass is mixed with additives, if desired, such as fast pyrolysis tars and petroleum asphalt, in order to modify its characteristics to meet specific needs of particular applications, and the resulting mixture is sprayed on coal fines typically preheated to at least 250 to 400° F. (in some cases up to 800° F.). Combustible extenders and fillers reinforcing fibers and cross-linking agents may be mixed with the coal prior to combination with the binder to provide additional specific properties to the mixture. The resulting well mixed mass is then pelletized by the application of pressure in conventional equipment.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENTS OF THE INVENTION

Figure 1:
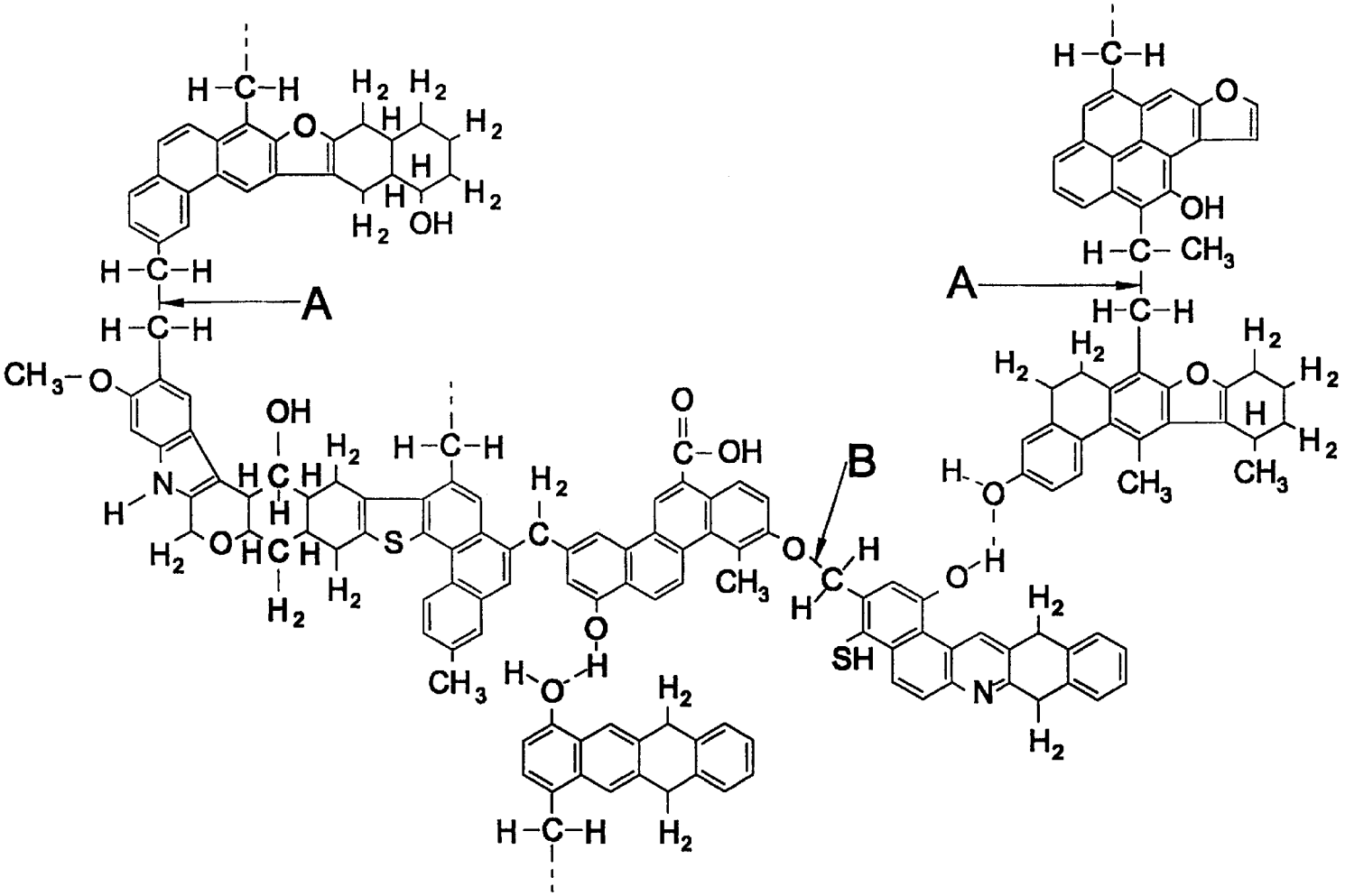
FIG. 1 shows the molecular structure of a typical coal cluster, illustrating linkages that are relatively easily broken by temperature degradation.

This invention is based on the idea of utilizing liquefied biomass as a binder for coal particles to produce concrete masses in the form of pellets or briquettes. I have discovered that unstabilized crude products derived from the direct liquefaction of biomass can be made to react with chemical groups on the surface of coal fines at elevated temperatures. The use of these reactive materials as binders for briquetting coal fines results in a coal briquette product with unique properties that, in combination with appropriate additives, can be tailored to enhance the characteristics of specific coal fines and to meet the needs of particular coal markets.

As used in this disclosure, the term biomass refers in general to any organic waste material that has been found to be suitable for conversion to liquid form by a process of liquefaction. In particular, and without limitation, biomass refers to organic material containing various proportions of cellulose, hemicellulose, and lignin; to manures; to protein-containing materials, such as soybeans and cottonseeds; and to starch-containing materials, such as grain flours. Hemicellulose is a term used generically for non-cellulosic polysaccharides present in wood. The term liquefaction refers to processes by which biomass is converted into liquid form by the application of high pressures in the absence of air and at approximate temperatures in the 230–370° C. range (about 450–700° F.), such as the process described in the Proceedings of the first Biomass Conference of the Americas, NREL/CP-200-5768, DE93010050, August 1995, published by the National Renewable Energy Laboratory. Direct liquefaction processes provide high yields of liquid products from biomass by the application of sufficient pressure, typically in the range of 200 to 3,000 psi. Indirect liquefaction processes first convert biomass to gases, which are then caused to react catalytically to produce liquids. As used herein, liquefied biomass refers to liquid products made by direct liquefaction of biomass. Finally, bio-binder base refers to the raw liquefied biomass produced by direct liquefaction for the process of the invention as a binder for coal fines, prior to any specific formulation by the addition of other components.

Typical coal fines from bituminous coals have 20–25 wt. % volatiles and an oxygen content of about 6–10 wt. %. However, coals are so heterogeneous that the scope of this invention should not be limited to these typical ranges. Bituminous coals normally have 2–5 wt. % of hydroxyl groups (—OH), typically distributed in three to five positions in each coal "molecule" entity. Some of these groups are reactive Bituminous coals usually also have about 0.5 to 10 wt. % of carboxyl groups (—COOH), depending to some extent on the degree of exposure of the coal to oxidation, either in the seam over centuries or after excavation from the ground. These and related groups are also reactive and can lead to spontaneous combustion of certain coals exposed to the high oxygen concentration of the atmosphere. Bituminous coals usually contain about half as many carbonyl groups (═CO) as carboxyl groups, with the concentration of both depending upon oxidative free-radical mechanisms. As a rule of thumb, bituminous coals are generally believed to contain up to 40–50 wt. % of their oxygen content in the form of unreactive (inert) ether groups (—O—). These groups are basically stable at temperatures below 300° C. (about 570° F.).

Figure 2:
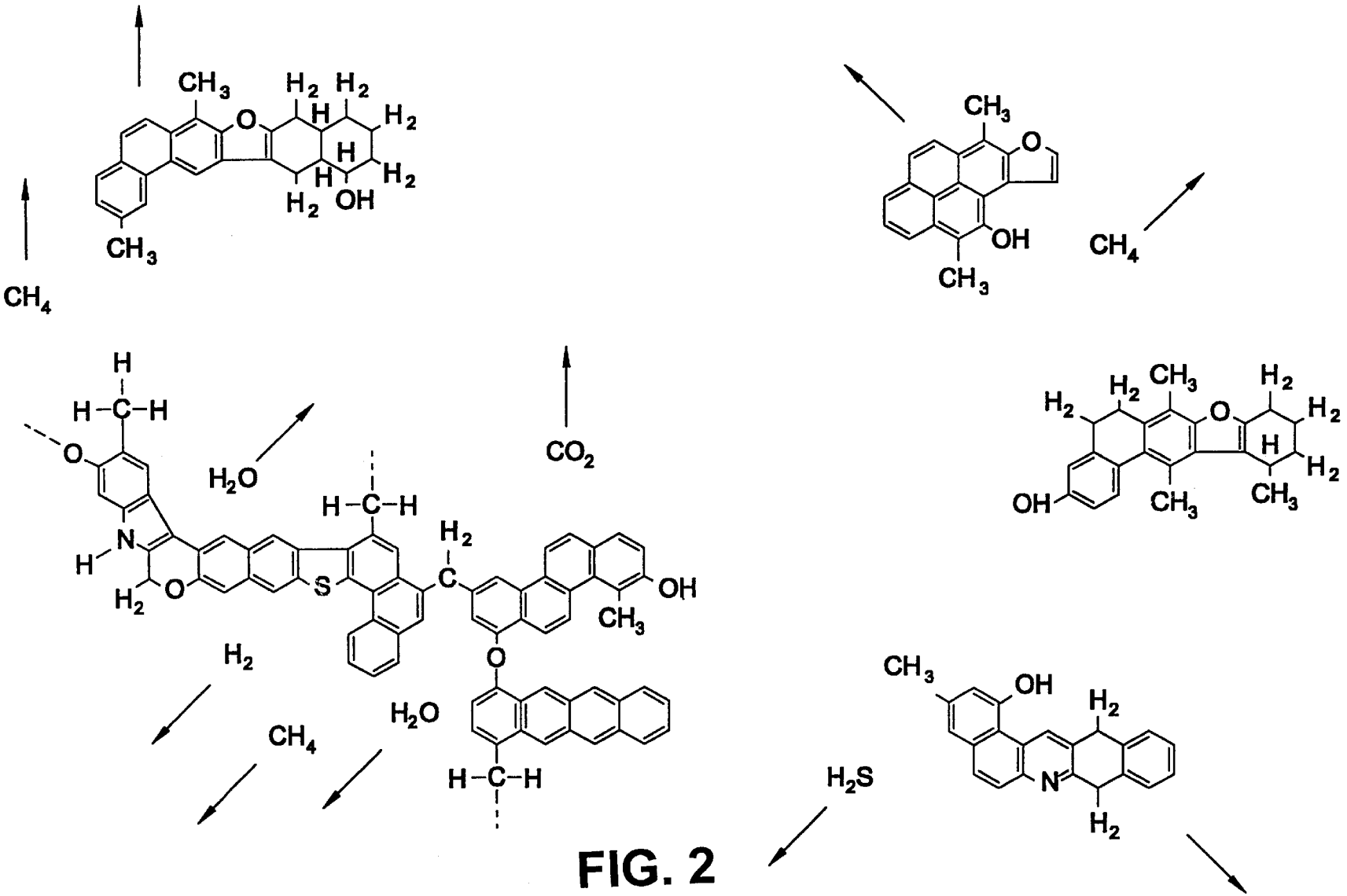
FIG. 2 shows the molecular structure of typical products of thermal decomposition of bituminous coal molecules, as derived from the coal cluster of FIG. 1.

Thus, bituminous coals are composed of randomly oriented, substituted, hydro-aromatic clusters tied together by short covalent linkages (such as, especially, methylene, ether, and biphenyl). A typical coal cluster molecule is shown in FIG. 1, where the reference symbols A and B correspond to linkages that are relatively easy to break by temperature degradation. Typical products of thermal decomposition of bituminous coal molecules, which begins in the range of 300–350° C. (about 570–660° F.), are shown in FIG. 2. Free radical reactions account for all covalent-bond breaking and forming processes from coal molecules, and for most types of hydrogen transfer. Considerable experimental and theoretical work has been done on free-radical reactions of bituminous coal degradation at all temperatures, ranging from 30° C. to 700° C. (about 85–1, 300° F.). See "Chemistry of Coal Utilization," Second Supplementary Volume, M. A. Martin Ed., Wiley-Interscience, 1981.

The liquefied biomass produced by direct liquefaction can have different chemical compositions and properties, depending on the liquefaction conditions. For example, ligno-celluloses in wood contain about 42 wt percent oxygen; depending on the severity of liquefaction conditions, the residual oxygen typically varies between 5 and 20 wt percent. Examples of different reaction conditions are reported by Rust Engineering, operator of the DOE Waste-to-Energy pilot plant in Albany, Oregon. The examples produce a tar-like product by the direct liquefaction of Douglas Fir wood, operating at about 3,000 psi and temperatures in the 615–660° F. range in the presence of a synthesis gas (67% carbon monoxide and 33% hydrogen) The resulting products varied from 3.2 to 18.1 wt percent in oxygen content and from 13,300 to 16,530 Btu/lb in heating value. Obviously, different raw materials also yield different liquefied biomass, which may vary in consistency from tar-like products to light oils.

A good source of base binder from biomass is the direct liquefaction of biomass by the Pittsburgh Energy Research Center (PERC) process; a successor to the Bureau of Mines facility where the initial biomass liquefaction research was conducted. The process utilizes a continuously stirred tank reactor system, aided by synthesis gas injection (carbon monoxide and hydrogen) and sodium carbonate catalyst. As a result of this process, shredded Douglas Fir softwood containing about 42 weight percent oxygen on a dry basis can be converted to a wood-derived tar with a heating value of about 15,000 Btu per pound and an oxygen content reduced to about 8–12 weight percent. This unstabilized tar is reactive with the surface of bituminous coal at temperatures above 300° F., as detailed in extensive proprietary laboratory analysis work conducted in 1996 by the Energy and Environmental Research Center at the University of North Dakota in Grand Forks, N.Dak.

The reactivity of PERC bio-binder base results in part from a significant quantity of reactive hydroxy groups in phenolic radicals. Some of the phenolics that have been identified by gas-chromatography/mass-spectrometry analytical analysis include 2,4,6-trimethyl phenol, 3,4,5-trimethyl phenol, 2,4,5-trimethyl phenol 2,3,5-trimethyl phenol, 2,3,5,6-tetramethyl phenol, 2-methyl-5-(1-methylethyl) phenol, 2-(1,1-dimethylethyl)-3-methyl phenol, 3,5-diethyl phenol, 2,3,4,6-tetramethyl phenol, 4-ethyl-2-methoxy phenol, 5-methyl-2-(1-methylethyl) phenol, 4-(1,1-dimethylethyl)-2-methyl phenol, 2-(1,1-dimethylethyl)-6-methyl phenol, and 2-acetyl-4,5-dimethyl phenol. Higher molecular-weight hydroxy groups have also been identified in the PERC bio-binder base. Similarly, active carboxylic acid groups have been identified in the biomass liquefaction binder, contained in degraded molecules of about 150–200 molecular weight, such as 4-(1-methylethyl) benzoic acid; and active naphthol groups have been identified in degraded molecules of about 180–200 molecular weight such as 5,7-dimethyl-1-naphthol and 6,7-dimethyl-1-naphthol.

The reactivity of bio-binder base was also confirmed by studies conducted at the University of Arizona by Y. Zhao (M. S. Thesis, 1987), R. J. Crawford (M. S. Thesis; 1989) and G. Chen (M. S. Thesis, 1995). Samples of liquefied biomass almost entirely soluble in tetrahydrofuran (THF) were heated in an autoclave in the absence of oxygen. Starting at temperatures of about 190° C., the liquefied biomass began liberating hydrogen; carbon monoxide, methane, ethane, ethylene, propane and propylene as reaction products. The remaining liquid was up to 50 percent by weight insoluble in THF, confirming that reactions had occurred that altered the composition of the liquefied biomass.

Thus, it is well known that any biomass; especially ligno-cellulosic material, can be converted into a heavy tar or oil by applying heat and pressure in the process; while retaining most of the heating value of the biomass feedstock in a more concentrated from. Water and carbon dioxide are driven off the biomass to make it more like a petroleum crude oil. For the purposes of this invention, the temperature and pressure can be adjusted to give a very viscous liquid product, which can be pumped at 250° C. (about 480° F.) but is a brittle solid at ambient temperatures. A majority of the hydroxyl groups of the cellulosic and lignin content of the biomass are removed as water and some of the carbon content is removed as carbon dioxide. Major chemical changes occurs, as shown by the typical elemental analysis of the wood feedstock and oil product shown below for the PERC process.

| | Chemical Analyses (Weight %) | |
|---|---|---|
| | Douglas Fir Feedstock | Crude Oil Product |
| Carbon | 49.0 | 82.2 |
| Hydrogen | 6.1 | 7.7 |
| Oxygen | 44.0 | 9.0 |
| Nitrogen | 0.1 | 0.05 |
| Sulfur | 0.1 | 0.05 |
| Ash | 0.7 | 1.0 |
| | 100.0 | 100.0 |

These data show that the high molecular weights of the cellulosic and hemi-cellulosic portions of the biomass have been degraded to lower molecular weight aromatic and aliphatic ethers, alcohols, hydrocarbons and a variety of other chemicals.

For the purposes of this invention, the binder composition can be tailored to a specific source of coal fines by proper blending with (a) other, less viscous materials, which can also be reactive materials; (b) other chemicals to react with the organic acids, aldehydes and hydroxy compounds in the bio-binder mass; (c) unburned volatiles recovered from the coals; (d) other binder-forming polymers; (e) cross-linking agents; and/or (f) agents to reinforce the final coal binder formulation.

The bio-binder base of the invention, whether in its original form or modified to a specific formulation, is combined with coal fines by chemical reactions, preferably by spraying followed by mixing steps, at temperatures in the 90 to 260° C. range (200 to 500° F.) and atmospheric pressure. Approximately 3 to 30 wt percent bio-binder mass was found to be suitable for good results, 3 to 10 wt percent being preferred. While the lower bio-binder content limit is important in order to ensure sufficient coverage of the surface of coal particles and correspondingly improve their agglomeration, the upper limit is only affected by economical considerations. Since the bio-binder mass has a high Btu content, usually higher than that of the coal it is binding, the heating value of the resulting briquette is not materially altered by using a high percentage of binder. The adhesive properties of the mix are similarly retained; therefore, there is no disadvantage to using high percentages of binder other than cost. Thus, various extenders, fillers, etc, are used to formulate a lower-cost bio-binder base with essentially the same reactive and binding properties of crude liquefied biomass. Obviously, the percentages of the various components vary with the nature of the bio-binder base and coal used, as one skilled in the art would recognize and be able to optimally determine. The mixture is blended for at least one to five minutes at the operating temperature to promote binding reactions to occur between the bio-binder base and the coal particles. Then the mixture is passed to a conventional pelletizer and processed according to well known pelletizing methods. It is noted that the binding reactions between the coal surface and the bio-binder are known to continue during and after the pelletizing process.

It has also been discovered that the bio-binder base of the invention can be treated in various manners without losing its basic advantage of being a reactive binder. For example, the bio-binder base can be extended by Type IV roofing asphalt, which acts as a diluent and lowers the viscosity of the formulated binder; extended by petroleum waxes, to decrease the creep of the binder; extended by low-molecular weight polyolefin polymers (high density polyethylene, linear polyethylene, polypropylene), to reduce the viscosity of the binder for easier spraying while retaining a high btu content; extended by crude calcium stearates, as lubricants to facilitate the release of the agglomerate from the mold during pelletization.

In addition, the bio-binder base can be mixed with other waste materials high in phenolics, such as tannins, lignin, wood bark, etc. These can either be (a) added as binder diluents prior to pelletizing, or (b) put through the liquefaction process. In either case, this increases the hydroxy group content of the binder for reaction with the coal fines just prior to pelletization. The binder can also be mixed with other waste-derived products, rich in aldehydes, such as crude furfural, derived from oat hulls, corncobs, wheat straws, and other sources of hemi-cellulose. As one skilled in the art would know, special reaction conditions are required if significant furfural amounts or other aldehydes are to be utilized.

The binder can also be mixed with a fraction of the light tars derived from charcoal production and with crude oils obtained by fast pyrolysis in order to provide additional reactive groups (derived from aldehyde and phenol radicals) to give more adhesion to the binder and allow a reduction in the amount of liquefied biomass utilized. Similarly, it can be mixed with degraded waste rubber tires or extended by nearly pure combustible materials, such as shredded newsprint, cardboard, pine needles, tree bark, tannins, lignins, oat hulls, wheat straws, wheat flours, corn flours, partially-degraded lignite coal, and partially-degraded peat, and various waste organic sludges.

Finally, the binder can also be cross-linked (just prior to pelletizing) by the addition of conventional phenol/formaldehyde, conventional urea/formaldehyde, conventional isocyanates, maleic anhydride (interfacial improvement), glycerol, and ethylene glycol (from waste anti-freeze); or reinforced by the addition of chopped natural or synthetic polymeric fibers, such as waste cotton, polypropylene upholstery, chopped carpets (polyesters/nylons), and chopped auto fluff material such as foam cushions.

Figure 3:
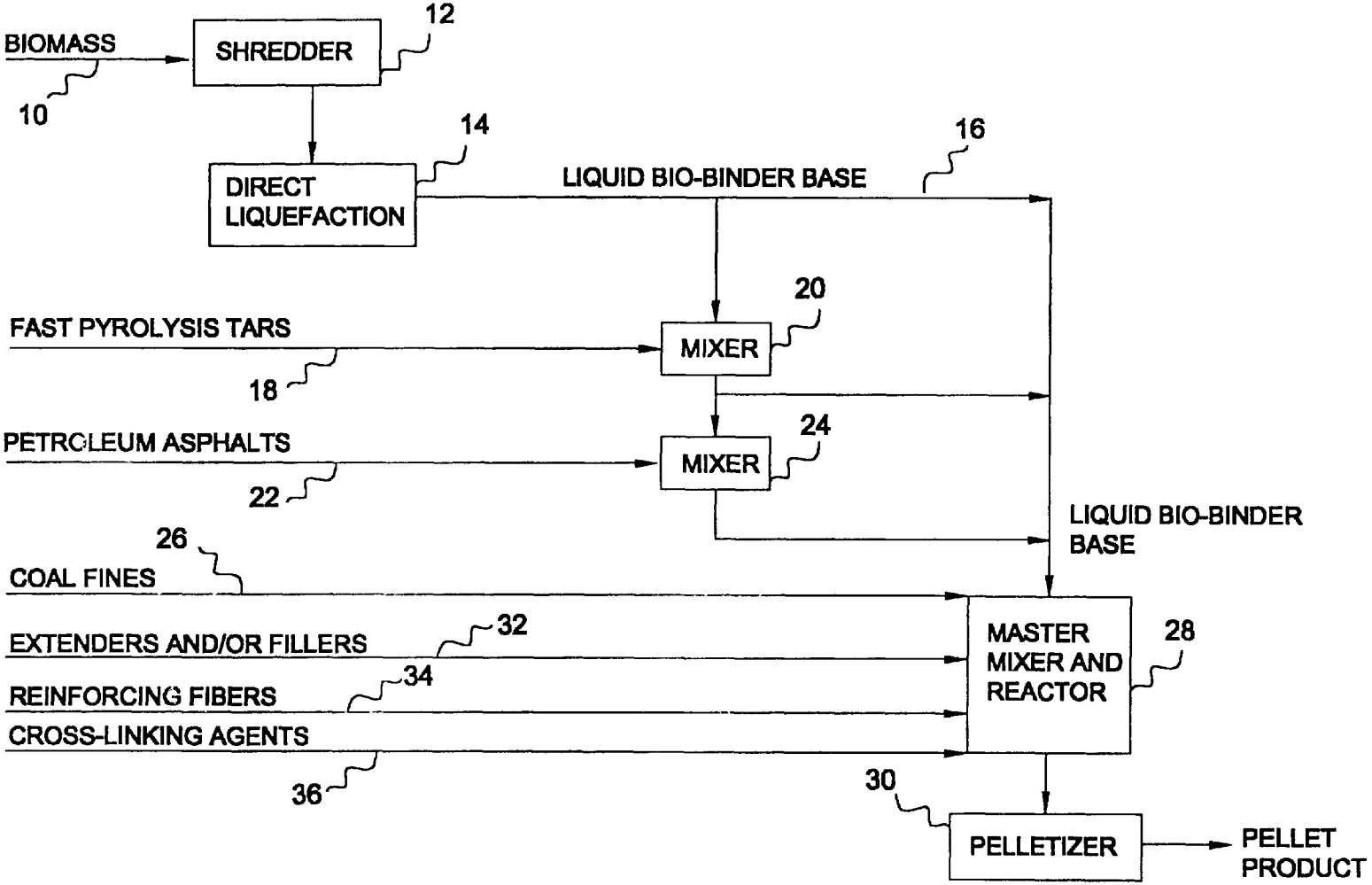
FIG. 3 illustrates the process of the invention, including the step of producing a specific bio-binder formulation for pelletizing coal fines.

FIG. 3 illustrates the process of formulating a specific bio-binder base and coal pellet from coal fines according to the invention. Biomass material 10 is sized in a shredder 12 and processed by direct liquefaction in a liquefaction reactor 14 to produce a liquified bio-binder base 16. As understood by those skilled in the art, the molecular weight and stage of reactivity for the bio-binder base 16 can be manipulated by controlling the operating conditions in the direct liquefaction process and in some cases by specifying the type of biomass 10 used, which can consist of wood, other lignocellulosic materials, ligning waste paper, agricultural organic wastes and/or manures.

The bio-binder base 16 can be modified by the addition of a portion of fast pyrolysis tars 18 in a first mixer 20; however, this modification is optional and can be used to obtain certain desired physical and chemical properties of the liquefied binder, such as providing additional reactive groups or replacing a portion of the biomass material with less expensive tars without loss of reactivity. Similarly, another option is the addition of a portion of petroleum asphalt 22 in another mixer 24. While the mixing operations of mixers 20 and 24 may be combined in a single unit, under certain circumstances it may be advantageous or desirable to keep them separate, such as for better control of viscosity and temperature and/or for good mixing conditions. The liquefied bio-binder from direct liquefaction (or as formulated in mixer 22 or mixer 24) can be used directly with coal fines 26, sprayed or otherwise combined with the coal and allowed to react in a master mixer 28 at a temperature and for a time sufficient for the active groups in the bio-binder base to react and bond with active groups in the surface of the coal fines. In order for such reactions to occur, it is known that a minimum temperature of about 60° C. is required (about 140° F.), higher temperatures being preferred, which can be achieved by preheating the entire coal or binder mass prior to contact, or by heating the mixture while stirring after a very short contact time. Since the reactive sites are only at the surface of the coal particles, it is not necessary to heat the entire mass of material; rather, it is more economical and sufficient to provide sufficient heat to reach the preferred reaction temperature of about 150 to 205° C. (about 300–400° F.) at the surface of the coal fines only. This is advantageously achieved by heating both the coal fines and the liquid bio-binder. After sufficient reaction time is allowed in reactor/mixer 28 for a cohesive mixture to be formed, the material is pelletized by the application of pressure in conventional coal pelletizer 30.

Another option is to also modify the coal fines characteristics by the addition of certain desired solid materials, which may include without limitation extenders and/or fillers 32 (such as plastic powder or soybean flour, used to change the particle size distribution of the coal fines), and/or fibers 34 (used to reinforce the structure of the pellet). Cross-linking agents 36 can also be utilized for enhancing certain physical characteristics (such as providing thermosetting properties, increasing the strength of the pellet, or providing brittleness for subsequent repulverization at power-plant locations). I found that all of these formulating steps can be taken without losing the inherent reactive qualities of the bio-binder base 16 and its ability to react with the coal fines to produce a superior coal pellet.

The invention is further illustrated by the following examples.

EXAMPLE 1

A bio-binder base material made by the PERC liquefaction process, using Douglas Fir sawdust, was poured as a hot liquid into a steel drum and allowed to solidify. Later, a portion of the material in the drum was melted by an electrical immersion heater, dipped out and allowed to solidify as "pancakes" upon a stainless steel tray, each being about 6–8 inches in diameter and about ¼ –1/2 inch in thickness. These samples could be shattered into small pieces by an impact hammer blow at 70° F. When these pancake-like samples were heated to about 100 to 120° F. they could still be broken by a sharp blow, but with more difficulty The latter properties at 120° F. were much like those of Type IV roofing asphalt at 70° F.

This PERC bio-binder base was modified by the addition of roofing asphalt as follows:

| | |
|---|---|
| PERC Bio-binder Base | 700 grams |
| Type IV Roofing Asphalt | 300 grams |
| Total Mix | 1000 grams |

These materials were thoroughly mixed and heated in metal cans on electrical hot plates to temperatures of 350–400° F., at which point the PERC bio-binder base began issuing some gases, showing that in its unstabilized form it was reacting further by decomposition. This process created additional free radicals. A portion of the hot mix was then further formulated with bituminous coal fines as follows:

| | |
|---|---|
| Coal Fines, Preheated to 190° F. | 90 grams |
| PERC Bio-Binder Mix | 5 grams |
| Asphalt Emulsion, 50/50 | 10 grams |

The preheated coal was pre-mixed with the hot PERC Bio-Binder Base and brought back up to 350 to 400° F. during this mixing. A "glob" of the asphalt emulsion, weighing 10 grams and consisting of 50 Wt. % asphalt and 50 Wt. % water, was then mixed into the blend to yield a hot, sticky mixture, which was immediately pressed into a coal pellet. A Pasadena hand press, capable of exerting up to 40,000 force-pounds was utilized to give 5000 to 30,000 psi pressures upon the coal pellets being formulated. This formulated binder gave good pellets under a variety of conditions, and later it was proven (as detailed below) that the binder was reactive and was bound chemically to the surface of the coal.

In order to demonstrate the reaction between the reactive groups in the bio-binder base and bituminous coal fines, the coal pellets resulting from the process of the invention were tested extensively at the Energy and Environmental Research Center of the University of North Dakota in Grand Rapids, N.D. A confidential report by Olson, Sharma and Young is summarized below Coal pellets made at the University of Arizona in Tucson, Arizona, by the process of Example 1, using waste bituminous coal fines from Harrison County, Ohio, had the following properties:

| | | |
|---|---|---|
| Volatile matter | 40.60 | wt % |
| Sulfur | 2.64 | wt % |
| Ash | 10.80 | wt % |
| Moisture | 3.00 | wt % |
| Heating Value | 11,722 | Btu/lb |

The bio-bindere as formulated for Example 1, had the following properties:

| | | |
|---|---|---|
| Volatile matter | 79.50 | wt % |
| Sulfur | 0.41 | wt % |
| Ash | 0.60 | wt % |
| Moisture | 0.70 | wt % |
| Heating Value | 14,899 | Btu/lb |

Figure 4:
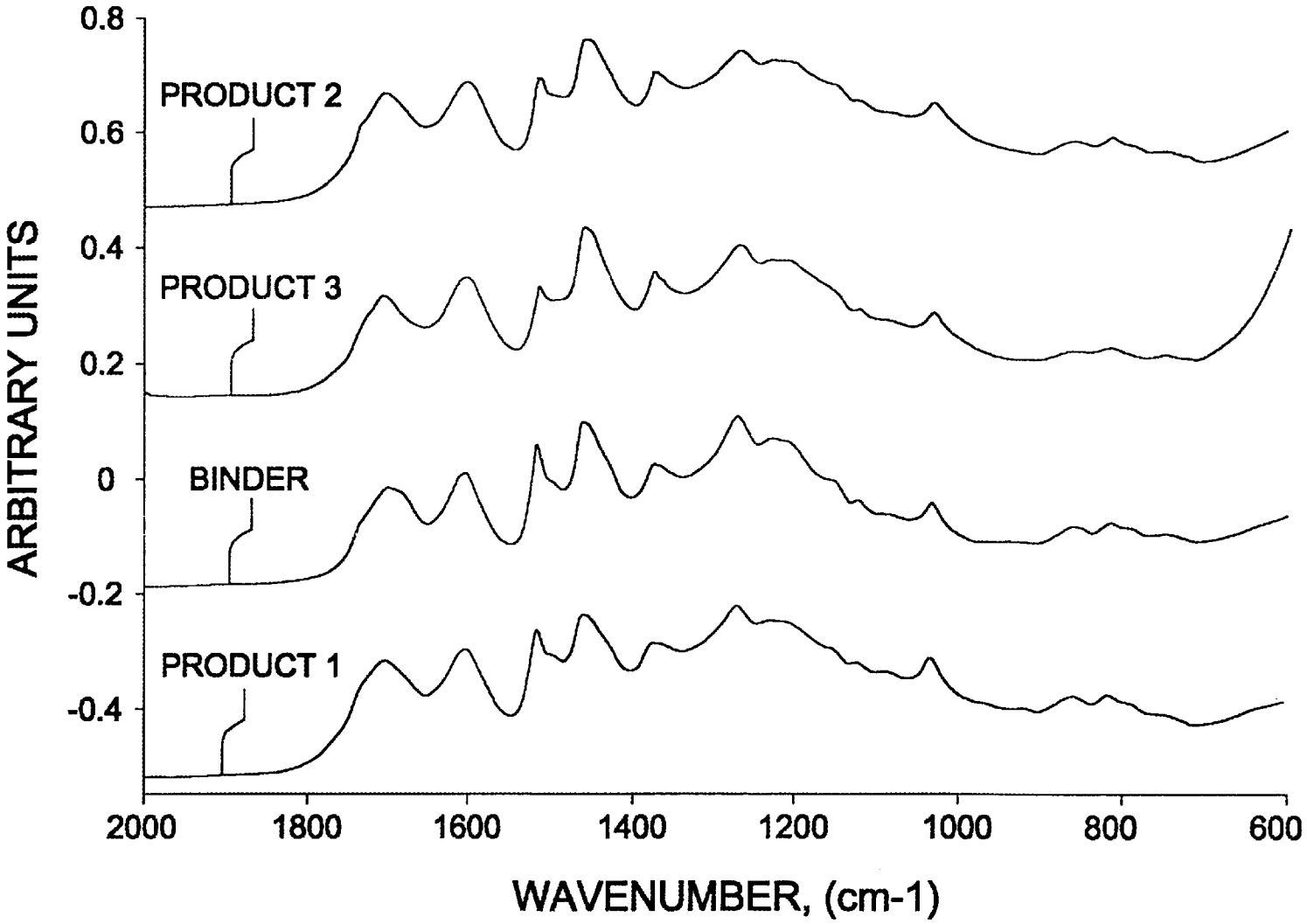
FIG. 4 is a comparison of normalized infrared spectra of a liquefaction bio-binder and extracts from three briquette products pelletized according to the invention.
Figure 5:
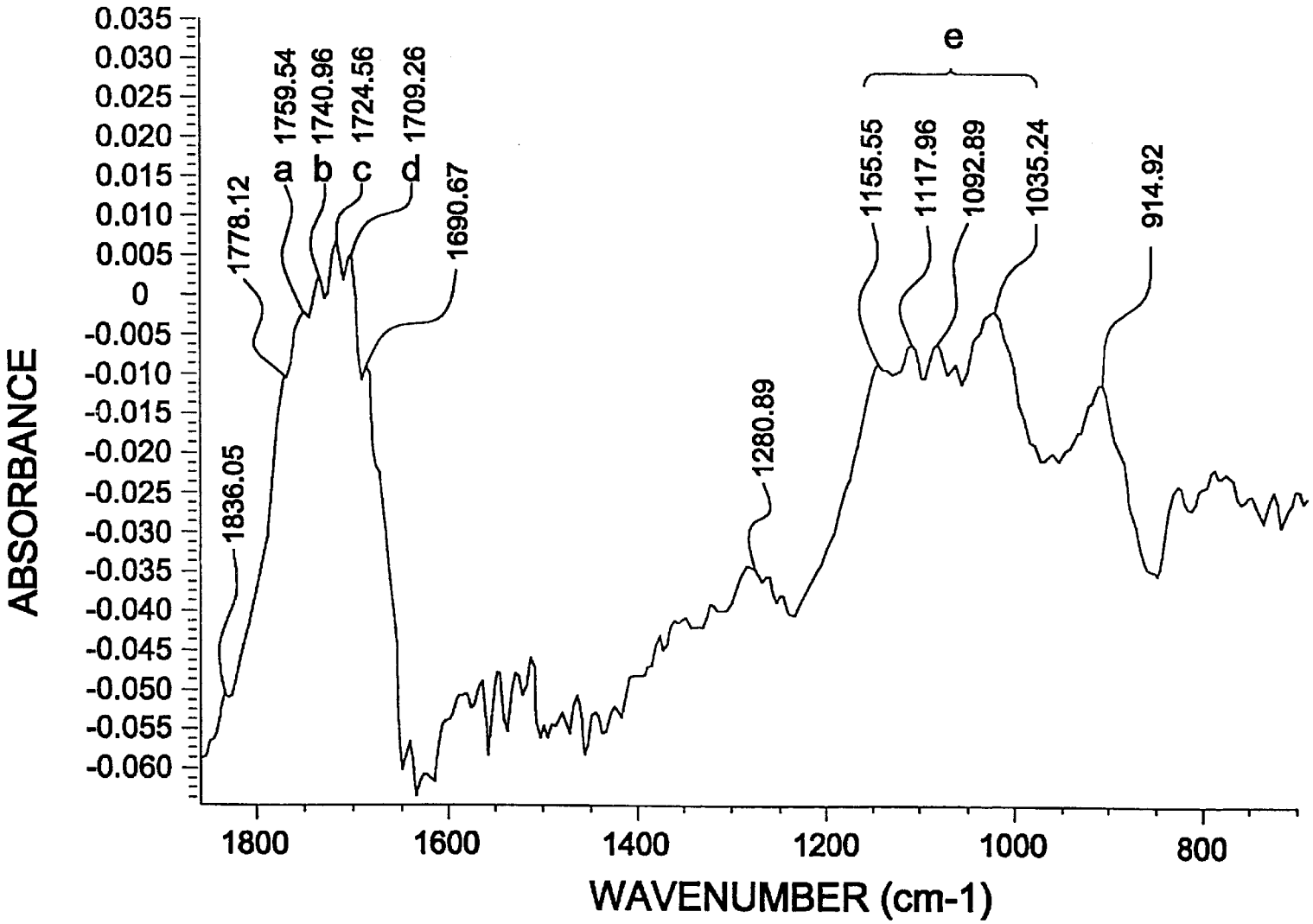
FIG. 5 illustrates the difference in the transmission spectrum between solid residue from coal fines and from pellets manufactured with the bio-binder base of the invention.

FIG. 4 shows the normalized infrared spectra (transmission absorbance in liquid solvent) of the liquefaction binder and of extracts of the binder taken from three pelletized products (one consisting of raw biomass and bio-binder; a second one consisting of coal fines extended by biomass and extra bio-binder; and a third one consisting of coal fines and less bio-binder). FIG. 5 is a transmission spectrum (by diffusion reflectance on solids) of the coal portion of a pellet manufactured by the process of the invention after extraction and separation of the unreacted bio-binder from the pellet. The figure shows 14 peaks corresponding to groups that are not present in the original coal particles; for example, the groups identified by reference symbols a,b,c,d,e are believed to correspond to a lactone, an ester or lactone, an aliphatic acids an aromatic acid, and "C—O" or "10—H" bonds, respectively. These differences demonstrate that reactions have occurred during the approximately ten-minute mixing of the bio-binder base with the coal fines, possibly during the two- to three-minute pelletizing process, and also possibly during the cooling or aging period immediately following pelletization. Extensive tests at North Dakota University used the following approaches to determine the chemical and physical changes occurring during pelletization of the bio-binder of the invention with coal fines and other component feedstocks. First, using standard ASTM (American Society for Testing and Materials) methods, proximate and ultimate analysis and calorific (Btu/lb) values were determined for the sample pellets and feedstock materials. A second approach entailed examining product pellets by optical microscopy at magnifications from 40 to 400 times using bright field or phase-contrast methods. Third, the pellets and the binder were dissolved in a suitable solvent, and the solvent extracts and recovered solids were analyzed using a Fourier transform infrared spectrometer to identify various chemical entities. Thermogravimetric analysis (TGA) was also conducted on the extracted solid. In addition to these approaches, the compressive strength of the pellets was also measured in an unconfined compression testing machine (manufactured by Soiltest, Inc.).

The infrared spectrum, taken in the transmission mode, of the original binder was compared to the transmission spectra of the extracted binders from each of three product pellets of different composition. The four normalized spectra (covering the spectral range 600 to 2000 wavenumbers) are seen in FIG. 4. As shown, there is no difference in any of the peaks of the four spectra, indicating that the binder extracted from the pelletized products is identical in composition to the original binder. This means that no chemical reaction occurred in the binder. The extraction is a physical rather than a chemical process; consequently, it would not reverse any chemical process that might have occurred during the binding process.

The product pellets were also extracted thoroughly with tetrahydrofuran to produce a solid residue in addition to the THF-soluble binder extracts described above. The solid residue obtained from the Ohio coal briquettes of Example 1 was analyzed by diffuse reflectance infrared Fourier transform spectrometry (DRIFTS), and the spectrum was compared with spectra of the original coal and a sample of the coal that had been heated to 150° C. in air for 10 minutes. The comparison was made by subtraction of the original coal spectrum from the recovered solid and from the heated coal.

The infrared spectrum of the solid residue from the briquette exhibited peaks corresponding to the aromatic, aliphatic, hydroxyl and ether structures normally found in a bituminous coal; however; additional peaks were present in the spectrum corresponding to carbonyl stretching frequencies and other carbon-oxygen bands. These peaks were of significant size so as to demonstrate that a chemical reaction of the coal had occurred during the pelleting process. The subtraction spectrum indicated that none of the features of the binder had been incorporated into the solid residue. That is, neither covalently bonded nor adsorbed binder material was present in the residue. In fact, the frequencies of the bands of the residue spectrum were consistent with those present in spectra of oxidized coals, as described in the literature and as recognized from previous work in oxidative coal processes. The subtracted spectrum, shown in FIG. 5, clearly indicated the presence of carboxylic acid, lactone, and anhydride moieties that developed during the processing. The spectrum of the sample that was oxidized at 150° C. exhibited a similar band corresponding to the oxygen-containing moieties.

These spectral investigations demonstrate that the coal was chemically altered during the process of mixing the hot bio-binder with the coal and the subsequent pelletizing. This chemical reaction was oxidative but did not lower the heating value of the product, and must therefore have occurred on the surface of the coal. The importance of this fact is that it enhanced the attractive forces of the binder to the coal surface. This bonding is believed to arise from hydrogen bonding and dipole forces, as illustrated in a model structure shown below, and not from covalent bonding. This enhancement of the surface-binder interactive forces results in observed high pellet strengths, as discussed below.

Suggested Mechanism for Bio-Binder Interaction with the Surface of Coal Fines.

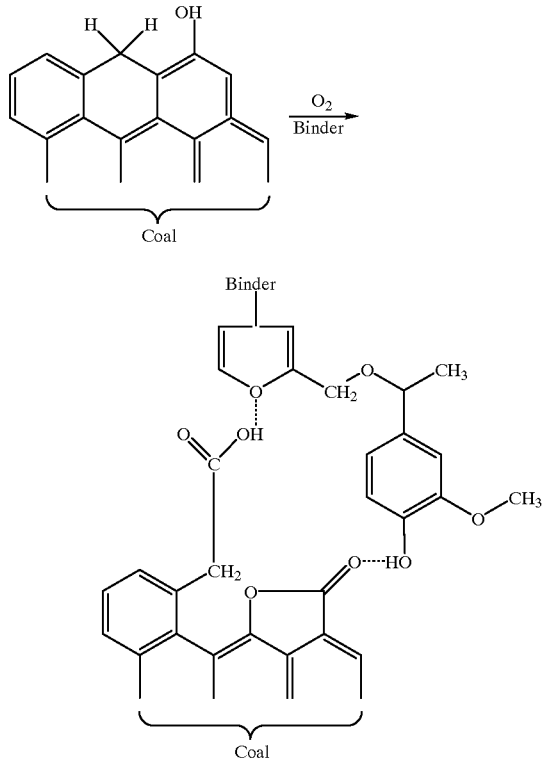

Two pellets of each of the three pelletized products used for the test of FIG. 4 were weighed, their dimensions measured, and subjected to a compressive load until the first break or crack in the pellet was noted. The mass, dimensions, and compressive strength data are listed in the table below.

Mass, Dimension, and Compressive Strength Data

| | Product No. 1 Biomass Fuel | Product No. 2 Biomass/ Coal Fuel | Product No. 3 Coal Fuel |
|---|---|---|---|
| Pellet 1: | | | |
| Weight, g | 8.43 | 7.72 | 13.19 |
| Diameter, in. | 1.032 | 1.020 | 1.014 |
| Dim. A, in. | 0.916 | 0.880 | 1.145 |
| Dim. B, in. | 0.416 | 0.378 | 0.637 |
| Strength Unit, in. | 0.0188 | 0.0375 | 0.0490 |
| Compressive Strength, lb/sq. in. | 142 | 315 | 246 |
| Pellet 2: | | | |
| Weight, g | 8.05 | 7.53 | 10.48 |
| Diameter, in. | 1.028 | 1.015 | 1.014 |
| Dim. A, in. | 0.852 | 0.884 | 1.982 |
| Dim. B, in. | 0.370 | 0.391 | 0.480 |
| Strength Unit, in. | 0.0372 | 0.0420 | 0.0266 |
| Compressive Strength, lb/sq. in. | 317 | 343 | 177 |

Product No. 1 consisted of a pelletized biomass/bio-binder mixture with no coal; Product No. 2 consisted of a coal/bio-binder mixture extended with raw biomass and with a large percentage of bio-binder; and Product No. 3 consisted of the coal/bio-binder mixture of Example 1. Note that the variation in mass was greatest (over 20% relative to the larger mass) with the coal fuel pellets which also weighed the most (10.5 g and 13.2 g), whereas the biomass/coal fuel pellets and biomass fuel pellets were fairly uniform, varying less than 5% in mass. In the manufacture of the pellets used for the tests, no attempt was made to equalize the weight of the different fuels. In contrast, the dimensions were very uniform.

All pellets showed high strength, ranging from over 140 to over 340 lb/sq. in. To calculate the force per unit area, it was assumed that the breaking plane of the pellets was across the central cylindrical portion of the pellet. Good coal briquettes typically have compressive strengths above 100 lb/sq. in.

The effects of extending and reinforcing the bio-binder by means of finely-ground sawdust and by using larger quantities of the bio-binder are shown in Product No. 1 and Product No. 2, respectively, where the resultant strength of the pellets is very high. Product No. 1 contained approximately 58 wt. % dried biomass (sawdust) and 42 wt. % bio-binder. Product No. 2 contained approximately 40 wt. % waste coal fines, 30 wt. % dried biomass (sawdust) and 30 wt. % bio-binder.

In summary, the use of liquefaction bio-binder with sawdust biomass, sawdust-waste coal fines, and waste coal fines yielded pellets having a good appearance and symmetry, and high strength, with little variation in mass for the biomass fuel and biomass-coal fines fuel pellets. All of the pellets exhibited a high heating value, >12,000 Btu/lb (as-received basis), with the coal fines fuel pellets exhibiting the highest value at 12,774 Btu/lb.

Chemical changes occurring in the pellets because of the process of the invention and incorporation of the bio-binder involve oxidation of the surface of coal fines and, very likely, hydrogen bonding at the coal-binder interface as depicted in FIG. 5. The spectral evidence discussed above clearly indicates that the chemical structure of the coal has been significantly altered by an oxidative process as a result of the briquetting processing. A consequence of the oxidation on the surface of the coal is to generate a more polar surface that can form stronger dipolar attractions to the binder molecules.

EXAMPLE 2

Additional pancake-like PERC bio-binder base was prepared from the same lot as used in Example 1 However, in this case it was placed in a deep freeze to cool, after which it was ground into a fine powder by a high-speed food blender. Similarly, Type IV roofing asphalt was cooled and converted into a fine powder. The PERC bio-binder base was then utilized to create a desirable binder for coal fines as follow:

| | |
|---|---|
| Coal Fines | 100 grams |
| PERC Bio-Binder Base | 10 grams |
| Type IV Roofing Asphalt | 10 grams |
| Asphalt Emulsion, 50/50 | 16 grams |
| Total | 136 grams |

The coal fines were preheated to 190° F. in an oven. The PERC bio-binder base and Type IV roofing asphalt powders were blended 50/50, and also preheated to about 120° F. This powdered mix was then blended with the coal fines in the above proportions, heated to 350–400° F., at which time the glob of asphalt emulsion was added, followed immediately be pelletizing in a 6-cavity mold, using about 5,300 psi of molding pressure The same pelletizing press as in Example 1 was used.

Payton waste coal fines from southern West Virginia were used in Example 2, one sample using raw Payton waste coal fines and a second sample using clean Payton coal fines, beneficiated to remove some of the dirt and inherent coal ash content. Again, as in Example 1, the bio-binder reacted with the surface of the coal, as shown in FIGS. 6 and 7.

The samples of Example 2 were prepared and tested at the Center in Applied Energy Research, University of Kentucky, Lexington, Ky., during the period September–October 1997. The waste coal samples were prepared in Huntington, W. Va., laboratories; the coal pellets using the bio-binder of Example 2 were prepared in the laboratories of the University of Arizona, Tucson, Ariz. During this testing, two sets of samples were analyzed based on raw and clean coals, as described above. The evaluation was conducted by fourier transform infrared spectroscopy on pressed KBr pellets in transmittance mode. For each sample set, spectra were obtained on the 1) parent coal/fines, 2) binder, 3) crushed pellets, and 4) an unpelletized blend (mixed at a temperature below 60° C.). The blend was included to provide baseline data and to help distinguish between potential chemical alterations due solely to the reactivity of the starting materials versus potential alterations attributable to the elevated temperatures and pressures used during briquetting.

Figure 6:
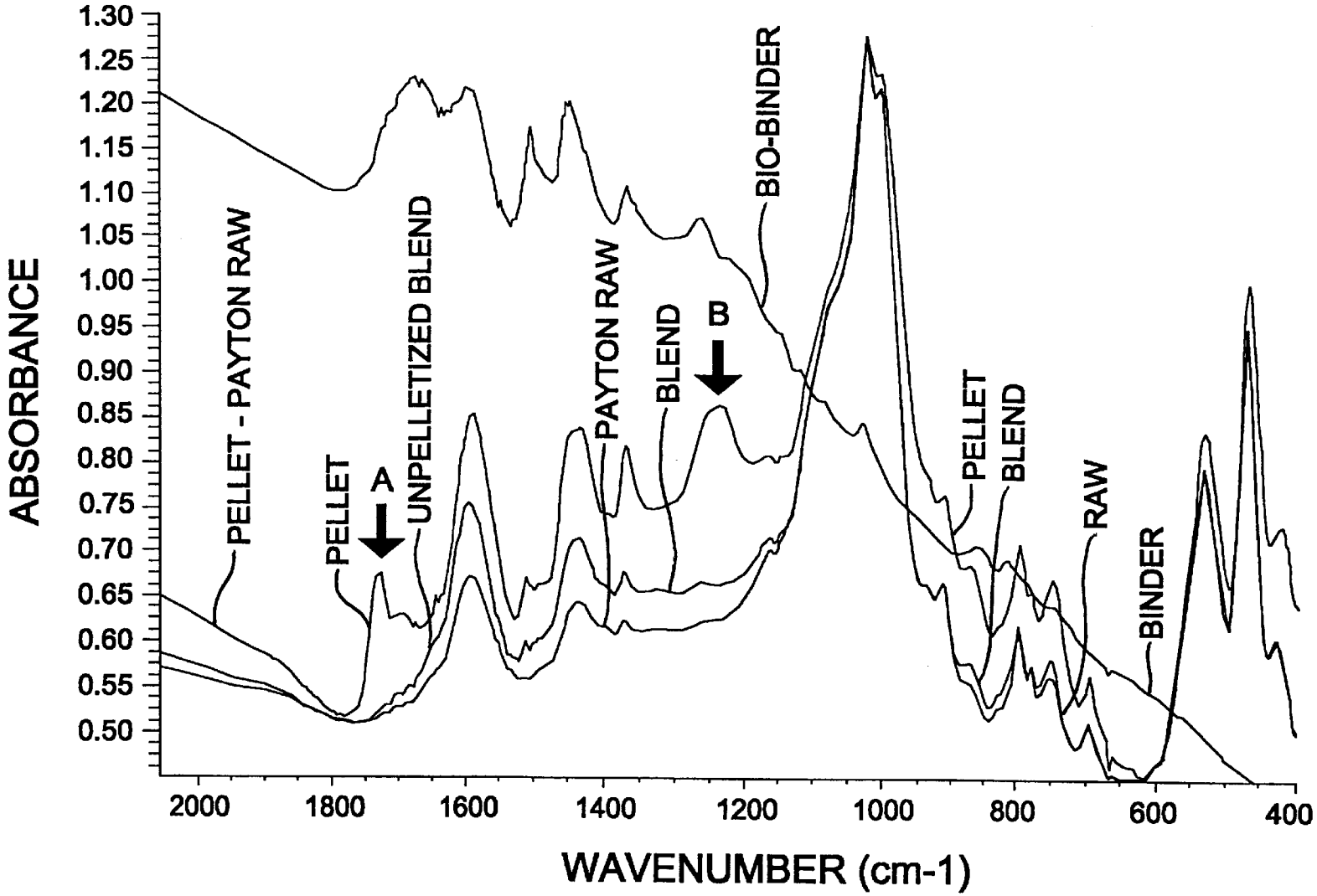
FIG. 6 illustrates the reactions of the bio-binder of the invention with Payton raw coal fines from West Virginia.
Figure 7:
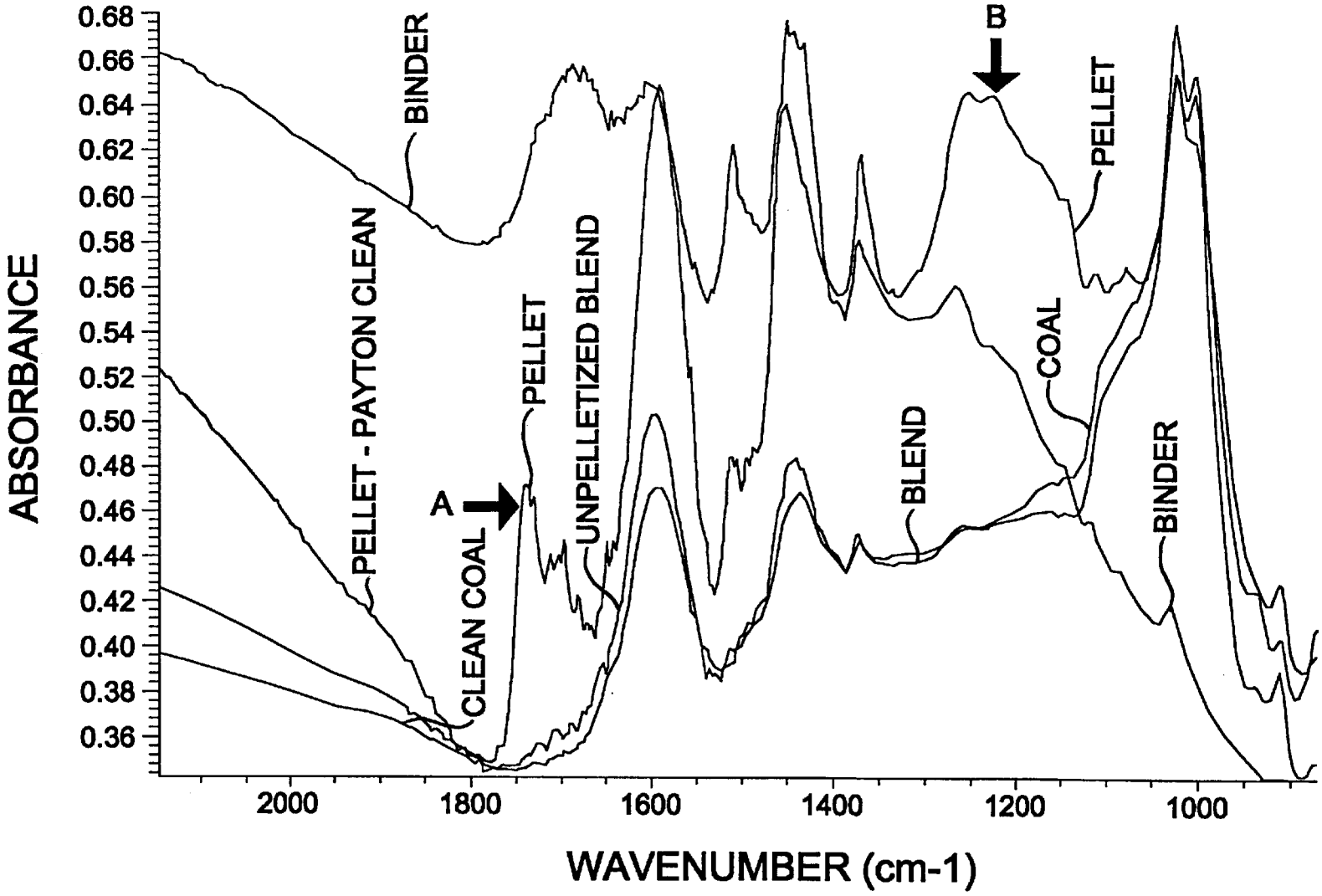
FIG. 7 illustrates the reactions of the bio-binder of the invention with Payton clean coal fines from West Virginia.

FIGS. 6 and 7 containing spectra of two sets of samples (parent, binder, blend, and pellet for each set). In examining these spectra for evidence of alteration, shifts in the frequency (right to left) are generally more important than vertical shifts (up and down) though the latter are significant if the vertical shift is due to the presence of chemical bonding that is absent in the starting materials. Two positions in each figure, highlighted by arrows A and B, indicate significant differences in the spectra of the product pellets relative to the starting ingredients (~1740 and ~1250 $cm^{-1}$). The shifts at both of these frequencies provide evidence of changes in the molecular bonding between carbon and oxygen atoms in the pelleted samples The ~1740 $cm^{-1}$ peak (arrow A) is most likely due to the formation or significant enhancement of carbonyl (C—O) functional groups and the ~1250 $cm^{-1}$ peak (arrow B) is possibly due to the formation of esters (specific assignments in this region are less reliable).

EXAMPLE 3

Using the PERC process, as operated by Rust Engineering at Albany, Oreg., wood flour was slurried into a recycled wood-derived oil. The slurry, together with aqueous sodium carbonate, carbon monoxide and hydrogen, was pumped through a preheater-reactor system at about 2,400 psi and 630 to 680° F. One long run was conducted as follows:

Wood totaling 21,970 pounds (dry basis) was fed for 572 hours at an average rate of 38.4 pounds per hour, resulting in an oil production of 11,027 pounds (water and solids free basis), as follows:

| | |
|---|---|
| Wood Feed Time | 572 hours |
| Wood Oil Concentration | 99.9+% |
| Viscosity of Crude Product | 135 cp at 210° F. |
| Specific Gravity of Crude Product | 1.11 |
| Solids | 1.8% |
| Gross Heating Value | 14,840 Btu/lb |
| Analysis (Dry Basis), Wt. %: | |
| Carbon | 78.9% |
| Hydrogen | 8.5% |
| oxygen | 12.3% |
| Nitrogen | 0.5% |
| Sulfur | 0.06% |
| Yield: | 53.3 lbs of wood-derived oil/ 100 lbs dry wood |

This crude wood-derived oil was fluid at 210° F., as shown above, but became a slightly brittle solid at 70° F. It had a softening point of about 120–140° F., where its properties were very similar to Type IV roofing asphalt at 70° F. Thus, it was suitable for use in this form as one type of bio-binder base. Further, it could be extended by adding Type IV roofing asphalt without losing its ability to react with the surfaces of waste coal fines, as shown in Example 1.

It is noted that the bio-binder base of the invention can be partially vacuum distilled to remove a portion of its lower molecular weight components, which have the lowest boiling points. This is illustrated in the example below.

EXAMPLE 4

In this case the bio-binder base of Example 3 was first distilled with waste ethylene glycol (anti-freeze for autos) to remove a light-fraction binary mixture, leaving a higher-boiling fraction of bio-binder that was then used in the final binder formulation. This vacuum fractionation produced a heavier formulation (with higher boiling point) for mixture with coal fines. This bio-binder has a higher molecular weight and increased tensile strength.

EXAMPLE 5

A low viscosity biomass-derived oil with certain desirable reactive characteristics, namely a higher concentration of aldehydes, can be prepared by biomass fast pyrolysis, and can be used to a certain extent in extending the bio-binder base of the invention. For example, the fast pyrolysis process developed by Georgia Institute of Technology in Atlanta, Ga., produces a pyrolytic oil with a heating value of about 12,000 Btu per pound and a typical chemical analysis as follows:

| | |
|---|---|
| Carbon | 65% |
| Hydrogen | 8.5% |
| Oxygen | 25% |
| Nitrogen | 0.9% |
| Sulfur | 0.1% |
| Ash | 0.5% |

This wood-derived oil can be used advantageously as an extender with the bio-binder base of the invention.

EXAMPLE 6

Another source for a wood-derived oil extender for the bio-binder base of the invention is the fast pyrolysis process developed at the University of Waterloo, Ontario, Canada. This pyrolysis process operates at atmospheric pressure and 450–490° C. with a residence time of about 0.5 seconds. For example, Western Hemlock sawdust processed under the above conditions produces a liquid-phase product with a variety of components including the following:

| | |
|---|---|
| Levoglucosan | 2.5% |
| Hydroxyacetaldehyde | 10.6% |
| Formaldehyde/formic acid | 4.0% |
| Acetol | 3.4% |
| Pyrolytic Lignin | 19.9% |

This wood-derived oil can be used not only as an extender for the bio-binder base of the invention, but also for further reaction with the coal particles because it has a high concentration of hydroxyacetaldehyde, organic acids and acetols, which can further react in the final coal-fines/binder formulation to give thermosetting and cross-linking properties.

EXAMPLE 7

Yet another source of a wood-derived oil extender is the Ablative Fast Pyrolysis process developed by the National Renewable Energy Laboratory in Golden, Colo. This process operates at up to 465° C. by entraining wood particles at very high velocities to create high centrifugal forces in a vortex reactor, thus vaporizing the surface of the wood particles as they generate frictional heat rubbing upon a hot surface. The process produces products similar to other fast pyrolysis processes, with an oxygen content of about 30 wt percent in the condensed oil phase, which is sufficiently polar to dissolve 15 to 35 weight percent in water, depending upon operating conditions. This wood-derived oil can be made to polymerize to a cross-linked higher-molecular weight tar, just by heating alone, because it is in a very unstabilized state immediately after preparation. Thus, it can be used to advantage as an extender in the bio-binder base of the invention, either during the formulation of the final coal binder prior to coal pelletization, or in a heat-aging step after pelletizing. This latter method of application pertains to all wood-derived oils made by various fast pyrolysis processes.

Figure 8:
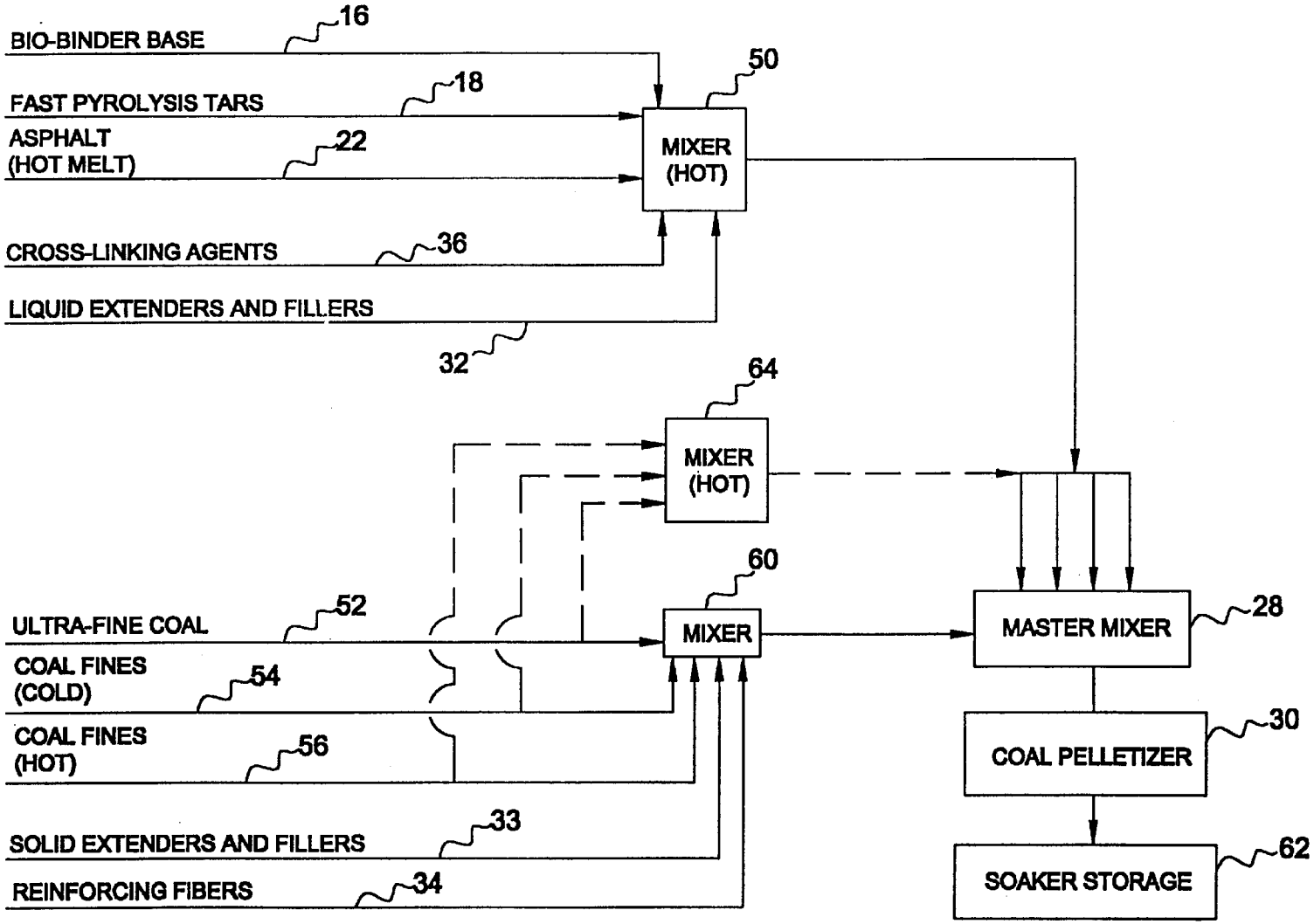
FIG. 8 illustrates a method of mixing all solid feedstock components in one mixer and all liquid feedstock components in a second mixer, and then blending these two mixtures in a master mixer prior to pelletizing.

FIG. 8 illustrates a method of blending and mixing the various feedstocks for using the bio-binder of the invention with formulated additives prior to pelletizing coal fines. All liquid feedstocks such as the bio-binder base 16 (hot), pyrolysis tars 18, hot asphalt 22, cross-linking agents 36 and/or liquid extenders and fillers 32 are blended and mixed in one individual mixer 50. In a separate operation, all solid feedstocks, such as ultra-fine coal 52, coal fines 54, hot coal fines 56, solid extenders and fillers 33 and/or reinforcing fibers 34 are blended and mixed in a second individual mixer 60. The liquid mix from 15 mixer 50 is sprayed upon the solid mix from mixer 60 in a master mixer 28, prior to dropping into the coal pelletizer 30.

The reaction of the bio-binder of the invention with the coal fines occurs in the master mixer 28, during the pelletizing in coal pelletizer 30 and/or in the soaker storage 62. If additional residence time for these reactions of the bio-binder base 16 with all coal fines is needed, one option is to utilize a third intermediate mixer 64, to which a portion of ultra-fine coal 52, cold coal fines 54 and/or hot coal fines 56 is conveyed and mixed prior to conveying to the master mixer 28.

Thus, it has been shown that biomass material can be used advantageously as an active binder in the preparation of coal pellets from coal fines. One significant advantage of the invention is that the bio-binder base is chemically derived from organic solid wastes and that essentially all additional components that may be used to formulate binders with specific properties are derived from other solid wastes. One of the preferred feedstocks for preparing the bio-binder base is shredded waste wood, from which a very viscous, tar-like, asphalt-like bio-binder base can be prepared. Other advantages of the invention are the improved strength of the pellets derived from the liquefied biomass and the flexibility allowed in the binder formulation for tailoring its characteristics to the properties of the coal fines of interest.

Various changes in the details, steps and components that have been described may be made by those skilled in the art within the principles and scope of the invention herein illustrated and defined in the appended claims. Therefore, while the invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. A coal pellet mixture comprising:

(a) a bio-binder base obtained from direct liquefaction of biomass material; and (b) coal fines wherein the bio-binder base is about three to thirty weight percent of the mixture, wherein the bio-binder base is produced by the direct liquefaction of cellulosic bio-material in the absence of oxygen.

2. A process for producing a coal pellet from coal fines comprising the following steps:

(a) preparing a mixture comprising liquefied bio-binder base and coal fines, wherein the liquefied bio-binder base is about three to thirty weight percent of the mixture;

(b) blending the mixture at a temperature between about 60° C. and 260° C. to produce a bonding reaction between the liquefied bio-binder base and the coal fines, thereby yielding a substantially uniform blend; and (c) compressively agglomerating the blend obtained from step (b) to produce a coal pellet, wherein the bio-binder base is produced by the direct liquefaction of cellulosic bio-material in the absence of oxygen.

3. The process of claim 2, further comprising the step of modifying the bio-binder base by adding a fast pyrolysis tar to the liquefied bio-binder base prior to carrying out step (a).

4. The process of claim 2, further comprising the step of modifying the bio-binder base by adding a petroleum asphalt to the liquefied bio-binder base prior to carrying out step (a).

5. The process of claim 2, further comprising the step of modifying the bio-binder base by adding a fast pyrolysis tar and a petroleum asphalt to the liquefied bio-binder base prior to carrying out step (a).

6. The process of claim 2, wherein step (a) is carried out by spraying the liquefied bio-binder base on the coal fines.

7. The process of claim 2, further comprising the step of adding combustible extenders or fillers to the coal fines prior to carrying out step (a), wherein said combustible extenders or fillers are selected from the group consisting of shredded newsprint, cardboard, pine needles, tree bark, tannins, lignins, oat hulls, wheat straws, wheat flours, corn flours, partially-degraded lignite coal, partially-degraded peat, waste organic sludges, and mixtures thereof.

8. The process of claim 2, further comprising the step of adding combustible reinforcing fibers to the coal fines prior to carrying out step (a), wherein said combustible reinforcing fibers are selected from the group consisting of natural polymeric fibers, synthetic polymeric fibers, and mixtures thereof.

9. The process of claim 2, further comprising the step of adding combustible cross-linking agents to the coal fines prior to carrying out step (a).

10. A coal pellet produced by the process of claim 2.

11. A coal pellet produced by the process of claim 6.

12. The mixture of claim 1, further comprising combustible reinforcing fibers selected from the group consisting of natural polymeric fibers, synthetic polymeric fibers, and mixtures thereof.

13. The mixture of claim 1, further comprising combustible cross-linking agents.

14. The mixture of claim 1, wherein said bio-binder base also comprises a fast pyrolysis tar.

15. The mixture of claim 1, wherein said bio-binder base also comprises a petroleum asphalt.

16. The mixture of claim 1, wherein said bio-binder base also comprises a fast pyrolysis tar and a petroleum asphalt.

17. The mixture of claim 1, further comprising combustible extenders or fillers selected from the group consisting of shredded newsprint, cardboard, pine needles, tree bark, tannins, lignins, oat hulls, wheat straws, wheat flours, corn flours, partially-degraded lignite coal, partially-degraded peat, waste organic sludges, and mixtures thereof.

* * * * *